US006140281A

United States Patent [19]

Blahey et al.

[11] Patent Number: 6,140,281

[45] Date of Patent: Oct. 31, 2000

[54] LONG LIFE LUBRICATING OIL USING DETERGENT MIXTURE

[75] Inventors: Alan Gary Blahey; James Walter Finch; Stanley James Cartwright, all of Sarnia, Canada

[73] Assignee: ExxonMobil Research and Engineering Company, Annnandale, N.J.

[21] Appl. No.: 09/464,529

[22] Filed: Dec. 15, 1999

[51] Int. Cl.[7] ..... C10M 135/18; C10M 129/54; C10M 129/76

[52] U.S. Cl. ..... 508/398; 508/413; 508/417; 508/518

[58] Field of Search ..... 508/398, 413, 508/417, 518

[56] References Cited

U.S. PATENT DOCUMENTS

| | | | |
|---|---|---|---|
| 5,547,597 | 8/1996 | Roganei et al. | 508/409 |
| 5,726,133 | 3/1998 | Blakey et al. | 508/390 |
| 5,906,969 | 5/1999 | Fybe | 508/364 |

*Primary Examiner*—Jacqueline V. Howard
*Attorney, Agent, or Firm*—Joseph J. Allocca

[57] ABSTRACT

A lubricating oil of enhanced life as evidenced by a reduction in viscosity increase, nitration, and TBN depletion and equivalent or improved oxidation and TAN increase performance relative to commercial oils comprises a major amount of a base oil of lubricating viscosity and a minor amount of a mixture of one or more metal sulfonate(s) and/or phenate (s) and one or more metal salicylate(s) detergents, all such detergents used in the mixture being of the same or substantially similar Total Base Number (TBN).

10 Claims, No Drawings

LONG LIFE LUBRICATING OIL USING DETERGENT MIXTURE

FIELD OF THE INVENTION

The present invention relates to lubricating oils of extended life as evidenced by a reduction in viscosity increase, nitration, and TBN depletion and equivalent or improved oxidation and TAN increase performance relative to commercial oils, said lubricating oil comprising a base oil of lubricating viscosity and a particular combination of detergents.

BACKGROUND OF THE INVENTION

Natural gas fired engines are large, having up to 16 cylinders, and often generating between 500–3000 HP. The engines are typically used in the Oil and Gas industry to compress natural gas at well heads and along pipelines. Due to the nature of this application, the engines often run continuously near full load conditions, shutting down only for maintenance such as for oil changes. This condition of running continuously near full load places severe demands on the lubricant. Indeed, since the lubricant is subjected to a high temperature environment, the life of the lubricant is often limited by oil oxidation processes. Additionally, since natural gas fired engines run with high emissions of oxides of nitrogen ($NO_x$), the lubricant life may also be limited by oil nitration processes. Therefore, it is desirable for gas engine oils to have long life through enhanced resistance to oil oxidation and nitration.

The combustion of diesel fuel often results in a small amount of incomplete combustion (e.g., exhaust particulates). The incombustibles provide a small but critical degree of lubrication to the exhaust valve/seat interface, thereby ensuring the durability of both cylinder heads and valves. The combustion of natural gas is often very complete, with virtually no incombustible materials. Therefore, the durability of the cylinder head and valve is controlled by the properties of the lubricant and its consumption rate. For this reason, gas engine oils are classified according to their ash content, since it is the lubricant ash which acts as a solid lubricant to protect the valve/seat interface. The oil industry has accepted guidelines which classify gas engine oils according to their ash level. The classifications are:

| Ash Designation | Ash Level (wt %, ASTM D874) |
|---|---|
| Ashless | Ash < 0.1% |
| Low Ash | 0.1 < Ash < 0.6 |
| Medium Ash | 0.6 < Ash < 1.5 |
| High Ash | Ash > 1.5 |

The ash level of the lubricant is often determined by its formulation components, with metal-containing detergents (e.g., barium, calcium) and metallic-containing antiwear additives contributing to the ash level of the lubricant. For correct engine operation, gas engine manufacturers define lubricant ash requirements as part of the lubricant specifications. For example, manufacturers of 2-cycle engines often require the gas engine oil to be Ashless in order to minimize the extent of harmful deposits which form on the piston and combustion chamber area. Manufacturers of 4-cycle engines often require the gas engine oils to be Low, Medium or High Ash to provide the correct balance of engine cleanliness, and durability of the cylinder head and valves. Running the engine with too low an ash level will likely result in shortened life for the valves or cylinder head. Running the engine with too high an ash level will likely cause excessive deposits in the combustion chamber and upper piston area.

Gas engine oil of enhanced life as evidenced by an increase in the resistance of the oil to oxidation, nitration and deposit formation is the subject of U.S. Pat. No. 5,726,133. The gas engine oil of that patent is a low ash gas engine oil comprising a major amount of a base oil of lubricating viscosity and a minor amount of an additive mixture comprising a mixture of detergents comprising at least one low Total Base Number (TBN) alkali or alkaline earth metal salt having a TBN of about 250 and less and a second alkali or alkaline earth metal salt having a TBN lower than the aforesaid component. The TBN of this second alkali or alkaline earth metal salt will typically be about half or less that of the aforesaid component.

The fully formulated gas engine oil of U.S. Pat. No. 5,726,133 can also typically contain other standard additives known to those skilled in the art, including dispersants (about 0.5 to 8 vol %), phenolic or aminic anti oxidants (about 0.05 to 1.5 vol %), metal deactivators such as triazoles, alkyl substituted dimercaptothiadiazoles (about 0.01 to 0.2 vol %), anti wear additives such as metal di thiophosphates, metal dithiocarbamates, metal xanthates or tricresyl-phosphates (about 0.05 to 1.5 vol %), pour point depressants such as poly (meth) acrylates or alkyl aromatic polymers (about 0.05–0.6 vol %), anti foamants such as silicone antifoaming agents (about 0.005 to 0.15 vol %), and viscosity index improvers, such as olefin copolymers, polymethacrylates, styrene-diene block copolmyers, and star copolymers (up to about 15 vol %, preferably up to about 10 vol %).

SUMMARY OF THE INVENTION

The present invention relates to a lubricating oil of extended life as evidenced by reductions in viscosity increase, nitration, and TBN depletion and equivalent or improved oxidation and TAN increase performance relative to current commercial oils and reference oil, and which comprises a major amount of a base oil of lubricating viscosity and a minor amount of a mixture of one or more metal sulfonate(s) and/or metal phenates, and one or more metal salicylate detergent(s). The lubricating oil may be especially useful as a gas engine oil.

DETAILED DESCRIPTION OF THE INVENTION

A lubricating oil is described comprising a major amount of a base oil of lubricating viscosity and a minor amount of a mixture of one or more metal sulfonate and/or metal phenate detergents and one or more metal salicylate detergents. Also described is a method for extending the life of lubricating oils as evidenced by a reduction in viscosity increase, nitration, and TBN depletion, and equivalent or improved oxidation and TAN increase performance relative to current commercial oils and reference oils by adding to the lubricating oil a minor amount of a mixture of one or more metal sulfonate and/or metal phenate detergents, and one or more metal salicylate detergents.

The lubricating oil base stock is any natural or synthetic lubricating base oil stock fraction typically having a kinematic viscosity at 100° C. of about 5 to 20 cSt, more preferably about 7 to 16 cSt, most preferably about 9 to 13 cSt. In a preferred embodiment, the use of the viscosity index improver permits the omission of oil of vis about 20 cSt or more at 100° C. from the lube base oil fraction used to make the present formulation. Therefore, a preferred base oil is one which contains little, if any, heavy fraction; e.g., little, if any, lube oil fraction of viscosity 20 cSt or higher at 100° C.

The lubricating oil basestock can be derived from natural lubricating oils, synthetic lubricating oils or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude. Suitable basestocks include those in API categories I, II and III, where saturates level and Viscosity Index are:

Group I—less than 90% and 80–120, respectively;

Group II—greater than 90% and 80–120, respectively; and

Group III—greater than 90% and greater than 120, respectively.

Natural lubricating oils include animal oils, vegetable oils (e.g., rapeseed oils, castor oils and lard oil), petroleum oils, mineral oils, and oils derived from coal or shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with variety of alcohols. Esters useful as synthetic oils also include those made from $C_5$ to $C_{12}$ monocarboxylic acids and polyols and polyol ethers. Tri alkyl phosphate ester oils such as those exemplified by tri-n-butyl phosphate and tri-iso-butyl phosphate are also suitable for use as base oils.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic, waxes are typically the wax produced by the Fischer-Tropsch process.

The resulting isomerate product is typically subjected to solvent dewaxing and fractionation to recover various fractions of specific viscosity range. Wax isomerate is also characterized by possessing very high viscosity indices, generally having a VI of at least 130, preferably at least 135 and higher and following dewaxing, a pour point of about −20° C. and lower.

The production of wax isomerate oil meeting the requirements of the present invention is disclosed and claimed in U.S. Pat. Nos. 5,049,299 and 5,158,671.

The detergent is a mixture of one or more metal sulfonate (s) and/or metal phenates with one or more metal salicylates. The metals are any alkali or alkaline earth metals, e.g., calcium, barium, sodium, lithium, potassium, magnesium, more preferably calcium, barium and magnesium. It is a feature of the present lubricating oil that each of the metal salts used in the mixture has the same or substantially the same TBN as the other metal salts in the mixture; thus, the mixture can comprise one or more metal sulfonate(s) and/or metal phenate combined with one or more metal salicylate (s) wherein each of the one or more metal salts is a low TBN detergent, or each is a medium TBN detergent or each is a high TBN detergent. Preferably each are low TBN detergent, each metal detergent having the same or substantially similar TBN below about 100. For the purposes of the specification and the claims, for the metal salts, by low TBN is meant a TBN of less than 100; by medium TBN is meant a TBN between 100 to less than 250; and by high TBN is meant a TBN of about 250 and greater. By the same or substantially similar TBN is meant that even as within a given TBN category, e.g., low, medium and high, the TBN's of the salts do not simply fall within the same TBN category but are close to each other in absolute terms. Thus, a mixture of sulfonate and/or phenate with salicylate of low TBN would not only be made up of salts of TBN less than 100, but each salt would have a TBN substantially the same as that of the other salts on the mixture, e.g., a sulfonate of TBN 60 paired with a salicylate of TBN 64, or a phenate of TBN 65 paired with a salicylate of TBN 64. Thus, the individual salts would not have TBN's at the extreme opposite end of the applicable TBN category, or varying substantially from each other.

The TBN's of the salts will differ by no more than about 15%, preferably no more than about 12%, more preferably no more than about 10%, or less.

The one or more metal sulfonates and/or metal phenates, and the one or more metal salicylates are utilized in the detergent as a mixture for example, in a ratio by parts of 5:95 to 95:5, preferably 10:90 to 90:10, more preferably 20:80 to 80:20.

The mixture of detergents is added to the lubricating oil formulation in an amount up to about 10 vol % based on active ingredient in the detergent mixture, preferably in an amount up to about 8 vol % based on active ingredient, more preferably up to about 6 vol % based on active ingredient in the detergent mixture, most preferably between about 0.3 vol % to 3 vol % based on active ingredient in the detergent mixture.

The lubricating oils of the present invention may contain, in addition to the aforesaid detergent mixture other additives typically used in lubricating oils such as anti-oxidants, dispersants, metal deactivators, anti wear additives, pour point depressants, anti foamatits, viscosity index improvers, etc.

The fully formulated oil may contain additional, typical additives known to those skilled in the industry, used on an as-received basis.

Thus, the fully formulated oil may contain dispersants of the type generally represented by succimides (e.g., polyisobutylene succinic acid/anhydride (PIBSA)-polyamine having a PIBSA molecular weight of about 700 to 2500). The dispersants may be borated or non-borated. The dispersant can be present in the amount of about 0.5 to 8 vol %, more preferably in the amount of about 1 to 6 vol %, most preferably in the amount of about 2 to 4 vol %.

Antioxidants may be of the phenol (e.g., o,o'ditertiary alkyl phenol such as ditertbutyl phenol), or amine (e.g., dialkyl diphenyl amine such as dibutyl, octyl buty, or dioctyl diphenyl amine) type, or mixtures thereof. More preferably, the antioxidants will be hindered phenols, or aryl amines which may or may not be sulfurized. Antioxidants can be present in the amount of about 0.05 to 2.0 vol %, more preferably in the amount of about 0.1 to 1.75 vol %, most preferably in the amount of about 0. 5 to 1.5 vol %.

Metal deactivators may be of the aryl thiazines, triazoles, or alkyl substituted dimercapto thiadiazoles (DMTD's), or mixtures thereof. Metal deactivators can be present in the amount of about 0.01 to 0.2 vol %, more preferably in the amount of about 0.02 to 0.15 vol %, most preferably in the amount of about 0.05 to 0.1 vol %.

Antiwear additives such as metal dithiophosphates (e.g., zinc dialkyl dithiophosphate, ZDDP), metal dithiocarbamates, metal xanthates or tricrecylphosphates may be included. Antiwear additives can be present in the amount of about 0.05 to 1.5 vol %, more preferably in the amount of about 0.1 to 1.0 vol %, most preferably in the amount of about 0.2 to 0.5 vol %.

Pour point depressants such as poly(meth)acrylates, or alkyl-aromatic polymers may be included. Pour point depressants can be present in the amount of about 0.05 to 0.6 vol %, more preferably in the amount of about 0.1 to 0.4 vol %, most preferably in the amount of about 0.2 to 0.3 vol %.

Antifoamants such as silicone antifoaming agents can be present in the amount of about 0.001 to 0.2 vol %, more preferably in the amount of about 0.005 to 0.15 vol %, most preferably in the amount of about 0.01 to 0.1 vol %.

Viscosity index Improvers (VII's) may be any polymer which imparts multifunctional viscosity properties to the finished oil, including materials such as olefin copolymers, polymethacrylates, styrene diene block copolymers, and star copolymers. The VII's may also be multifunctional from the perspective of offering secondary lubricant performance features such as additional dispersancy. VII's can be present in the amount of up to 15 vol %, more preferably in the amount of up to 13 vol %, most preferably in the amount of up to 10 vol %.

Lubricating oil additives are described generally in "Lubricants and Related Products" by Dieter Klamanm, Verlag Chemie, Deerfield, Fla., 1984, and also in "Lubricant Additives" by C. V. Smalheer and R. Kennedy Smith, 1967, pages 1–11, the disclosures of which are incorporated herein by reference.

The present invention is further described in the following non-limiting examples and comparative examples.

EXPERIMENTAL a) Lab Nitration Screener Test Results

A lab nitration screener test was used in initial testing to guide in the selection of antioxidants, and viscosity index improvers (VIIs). The test results identify a number of parameters for assessing the used oil performance, including viscosity increase, oxidation, nitration, TAN increase, and TBN depletion. All measurements are reported on a relative basis (unless otherwise indicated) so that results greater than unity (e.g., viscosity increase, or TBN depletion) represent greater levels of lubricant degradation. Thus, numerically lower relative results represent a measure of longer oil life. In each test, a Reference Oil is always tested unless otherwise indicated. Results are reported as a ratio of the result for the test oil divided by the result for the Reference Oil. For example, if a test oil has an oxidation result of 1.0, then it has an oxidation performance equal to that of the Reference Oil. If the test oil has an oxidation result less than 1.0, then the test oil demonstrates oxidation performance superior to that of the Reference Oil.

Reference Oil A is an oil using as base oil a mixture of hydrocracked 600N base oil and solvent refined 1200N base oil, to which is added a pour point depressant and about 9.6 vol % of a commercial additive, Oloa 1255. Oloa 1255 is one of the most widely sold gas engine oil additive packages and represents, therefore, a "benchmark standard" against which other formulations may be measured. Reference Oil B is based on a mixture of solvent extracted and hydrocracked base oils containing the additives recited in Table 2 and is used as the benchmark against which the test formulation based on hydrocracked base oils is compared. Reference Oil B* is a different batch of the Reference Oil B blended at a different time, but with the same ingredients and to the same formulation specification.

Example 1

Lab nitration screener test results and oxidation screener test results are summarized in Table 1. An oil of the present invention is compared against a commercial oil and three comparative oils. Nitration Screener test results are reported (where indicated) relative to a reference oil, the performance of which is deemed to be 1, in each category of performance evaluated.

Results show that the oil of the invention, the oil containing the mixture of sulfonate and salicylate detergents of the substantially same TBN exhibited superior resistance to nitration, viscosity increase, and TBN depletion percent as compared against all the other oils reported (Commercial oil and Comparative oils 1, 2 and 3) which employed different detergents or mixtures of detergents, and improved oxidation and TAN increase (TAN units) with respect to the Commercial Oil and Comparative Oil 1. With respect to Comparative Oils 2 and 3, the oil of the present invention achieved superior resistance to nitration, viscosity increase and TBN depletion and superior oxidative performance versus Comparative Oils 1 and 2. While Comparative Oils 2 and 3 recorded superior (i.e., lower) TAN increase and Comparative Oil 3 reported superior oxidation performance, the oil of the present invention outperformed those oils in overall terms considering all the areas of measurement.

The oil of the present invention containing a mixture of metal sulfonate and metal salicylate detergents generally outperformed in terms of nitration, viscosity increase and TBN depletion (%) those oils containing combinations of metal sulfonate with metal phenate detergents, or just metal sulfonate or metal salicylate detergents.

In the Oxidation Screener test (Seq. III-E test) the oil of the present invention outperformed the Commercial Oil (an oil containing a mixture of metal sulfonate and metal phenate) and Comparative Oil 1 (an oil containing a mixture of metal sulfonate and metal phenate).

Example 2

The results in Table 2 for the formulations presented there show that the oil of the invention, containing the combination of metal phenate with metal salicylate of the same or similar TBN, outperforms Reference Oil B, and Comparative Oil 4 (oils which use the same combination of solvent extracted and hydrocracked base oils but which respectively use a mixture of higher TBN phenate and lower TBN sulfonate, or high TBN phenate and lower TBN salicylate). The oil of the present invention, containing a mixture of low TBN metal phenate, and low TBN metal salicylate detergents provided superior control of oxidation, nitration, and viscosity increase relative to those oils containing mixtures of metal phenate and metal sulphonate, or metal phenate and metal salicylate of dissimilar TBN.

TABLE 1

Test Formulations and Screener Test Results

| Description | Commercial Oil | Reference Oil A | Example 1 | Comparative Oil 1 | Comparative Oil 2 | Comparative Oil 3 |
|---|---|---|---|---|---|---|
| 600 SN Base Oil | 90.889 | | 88.669 | 91.549 | 88.209 | 86.559 |
| 1200 SN Base Oil | 0.00 | | 2.00 | 1.500 | 5.50 | 1.00 |
| 60 TBN Barium Sulfonate + 65 TBN Calcium Phenate | 5.26 (2.4% AI) | | | | | |
| 60 TBN Barium Sulfonate Detergent | — | | 1.00 (0.47% AI) | 1.00 (0.47% AI) | 2.45 (1.14% AI) | — |
| 64 TBN Calcium Salicylate | — | | 4.49 (1) (2.25% AI) | — | — | 8.60 (4.30% AI) |
| 135 TBN Calcium Phenate | — | | — | 2.11 (1) (1.08% AI) | — | — |
| Balance of Commerical Additive System | 3.841 | | 3.841 | 3.841 | 3.841 | 3.841 |
| Reference Oil A | — | 100.00 | — | — | — | — |
| Viscosity | | | | | | |
| Target kV @ 100° C. | 13.2 | 13.5 | 13.2 | 13.2 | 13.2 | 13.2 |
| Measured kV @ 100° C. | 13.35 | 13.7 | 13.08 | 13.23 | 13.27 | 13.10 |
| Measured kV @ 40° C. | 128.6 | 131.0 | 124.8 | 128.3 | 128.5 | 122.6 |
| Elemental | | | | | | |
| Barium (ppm) | >1500 | | >1500 | >1500 | | |
| Calcium (ppm) | 1180 | | 1070 | 1140 | | |
| Oxidation Screener Test | | | | | | |
| Hours to 200% viscosity increase | 45 | 110 | 87 | 53 | | |
| Hours to 300% viscosity increase | 52 | 114 | 95 | 59 | | |
| Hours to 375% viscosity increase | 55 | 116 | 98 | 64 | | |

TABLE 1-continued

Test Formulations and Screener Test Results

| Description | Commercial Oil | Reference Oil A | Invention | Comparative Oil 1 | Comparative Oil 2 | Comparative Oil 3 |
|---|---|---|---|---|---|---|
| Nitration Screener Test | | | | | | |
| Reference Oil | Oil A | Oil A | Oil A | Oil A | Oil A | Oil A |
| Oxidation (relative to Reference Oil) | 1.20 | 1.00 | 0.90 | 1.17 | 1.12 | 0.77 |
| Nitration (relative to Reference Oil) | 1.05 | 1.00 | 0.83 | 1.10 | 1.22 | 0.93 |
| Viscosity increase (relative to Reference Oil) | 0.72 | 1.00 | 0.32 | 0.64 | 0.67 | 0.43 |
| TAN increase (TAN units) | 2.0 | 1.57 | 1.7 | 2.3 | 1.11 | 1.23 |
| TBN Depletion (%) | 55 | 80 | 10 | 22 | 78 | 51 |

TABLE 2

TEST FORMULATIONS AND NITRATION TEST RESULTS

| Description | Reference Oil B* | Example 2 | Reference Oil B | Comparative Oil 4 |
|---|---|---|---|---|
| 1200 SN Base oil (Group 1) | 6.00 | 6.00 | 6.00 | 6.00 |
| Chevron Group II Basestock | 85.62 | 86.14 | 85.62 | 85.36 |
| 135 TBN Ca phenate detergent | 1.78 | — | 1.78 | 1.78 |
| Neutral Ca sulphonate (26 TBN) | 0.81 | — | 0.81 | — |
| Neutral Ca alkyl-salicylate (64 TBN) | — | 1.07 | — | 1.07 |
| Neutral Ca phenate (65 TBN) | — | 1.00 | — | — |
| Balance of Additive System | 5.79 | 5.79 | 5.79 | 5.79 |
| Viscosity measured kV @ 100° C. | 12.95 | 12.86 | 12.98 | 12.85 |
| Nitration Screener Test | | | | |
| Reference Oil | Oil B* | Oil B* | Oil B | Oil B |
| oxidation (relative) | 1.00 | 0.91 | 1.00 | 1.04 |
| nitration (relative) | 1.00 | 0.75 | 1.00 | 1.04 |
| viscosity increase (relative) | 1.00 | 0.92 | 1.00 | 0.95 |

Notes: 1) B* is a repeat blend of (B) using same components and exact same formulation.

What is claimed is:

1. A method for enhancing the life of a lubricating oil as evidenced by a reduction in viscosity increase, nitration, TBN depletion comprising adding to a lubricating oil comprising a major amount of an oil of lubricating viscosity a minor amount of a mixture of metal salt detergents comprising one or more metal sulfonate(s) and/or one or more metal phenates combined with one or more metal salicylate (s) wherein each metal salt detergent in the mixture has the same or substantially the same total base number as every other metal salt detergent in the mixture.

2. The method of claim 1 wherein the metal components of the metal sulfonate(s) the metal phenate and the metal salicylate(s) are the same or different and are selected from the group consisting of alkali metal and alkaline earth metal.

3. The method of claim 1 wherein the one or more metal sulfonate(s) and/or metal phenate(s), and the one or more metal salicylate(s) are low total base number detergents.

4. The method of claim 1 wherein the one or more metal sulfonate(s) and/or one or more metal phenate(s) and the one or more metal salicylate(s) are medium total base number detergents.

5. The method of claims 1, 2, 3 or 4 wherein the one or more metal sulfonate(s) and/or one or more metal phenate (s), and the one or more metal salicylate(s) in the mixture are used in a sulfonate to salicylate ratio or phenate to salicylate ratio by parts of 5:95 to 95:5.

6. The method of claim 5 wherein the sulfonate and/or phenate to salicylate ratio by parts is 10:90 to 90:10.

7. The method of claims 1, 2, 3 or 4 wherein the mixture of one or more metal sulfonate(s) and/or metal phenate(s) and the one or more metal salicylate(s) is used in an amount of up to about 10 vol % in the finished oil formulation.

8. The method of claim 5 wherein the mixture of one or more metal sulfonate(s) and/or metal phenate(s), and the one or more metal salicylate(s) is used in an amount of up to about 10 vol % in the finished oil formulation.

9. The method of claim 6 wherein the mixture of one or more metal sulfonate(s) and/or metal phenate(s), and the one or more metal salicylate(s) is used in an amount of up to about 8 vol % in the finished oil formulation.

10. The method of claims 1, 2, 3 or 4 wherein the mixture of one or more metal sulfonate(s) and/or metal phenate(s), and the one or more metal salicylate(s) is used in an amount of up to about 6 vol % in the finished oil formulation and the sulfonate and/or phenate and the salicylate are in a ratio by parts of 20:80 to 80:20.

* * * * *